United States Patent [19]

Wagstaffe

[11] 4,261,174

[45] Apr. 14, 1981

[54] TEMPERATURE SENSITIVE ACTUATOR AND FAN

[75] Inventor: Aubrey H. Wagstaffe, Solihull, England

[73] Assignee: Quinton Hazell Limited, Clwyd, Wales

[21] Appl. No.: 939,701

[22] Filed: Sep. 5, 1978

[30] Foreign Application Priority Data

Sep. 5, 1977 [GB] United Kingdom ..... 36956/77

[51] Int. Cl.[3] ..... F01B 29/10

[52] U.S. Cl. ..... 60/527; 416/39; 73/363.3; 236/102

[58] Field of Search ..... 416/39, 136, 169 A; 60/527; 73/363, 363.1, 363.3, 363.5; 236/101 R, 101 D, 102; 337/382, 396

[56] References Cited

U.S. PATENT DOCUMENTS

| | | | |
|---|---|---|---|
| 564,979 | 8/1896 | Dixon et al. | 73/363.1 |
| 1,273,574 | 7/1918 | Brombacher | 73/363.1 |
| 1,382,116 | 6/1921 | Olson | 73/363.1 |
| 1,919,586 | 7/1933 | Dodge | 416/136 |
| 2,067,633 | 1/1937 | Hafner | 416/136 |
| 2,483,913 | 10/1949 | Lampton | 416/136 |
| 3,217,808 | 11/1965 | Elmer | 416/53 |
| 3,220,484 | 11/1965 | Elmer | 416/39 |
| 3,260,312 | 7/1966 | Elmer | 416/230 |
| 3,265,047 | 8/1966 | Elmer | 123/41.12 |
| 3,299,963 | 1/1967 | Lowe | 416/39 |
| 3,388,694 | 6/1968 | Elmer | 123/41.12 |
| 3,408,725 | 11/1968 | Grayson | 29/447 |
| 3,987,630 | 10/1976 | Hein et al. | 60/527 |
| 4,029,434 | 6/1977 | Kenney | 416/41 |

FOREIGN PATENT DOCUMENTS

| | | | |
|---|---|---|---|
| 757714 | 2/1953 | Fed. Rep. of Germany | 416/39 |
| 611735 | 10/1960 | Italy | 416/39 |
| 1257938 | 12/1971 | United Kingdom | 416/39 |

*Primary Examiner*—Allen M. Ostrager
*Assistant Examiner*—Stephen F. Husar

[57] ABSTRACT

A temperature-sensitive actuator particularly for varying the pitch of blades spaced around a cooling fan hub. The actuator, as applied to a fan, includes at least first and second circular or part-circular elongate members within the hub, restraining means on the hub for one end of the first elongate member, support means for the first elongate member having a coefficient of expansion different from that of the first elongate member, and which inhibits radial deformation of the first elongate member during thermal expansion or contraction whereby the free end of the first elongate member moves circumferentially, means for transmitting movement of the first elongate member to the second elongate member, and further means between the second elongate member and the blades to vary the pitch of the blades in response to the combined thermal expansion or contraction of the elongate members.

9 Claims, 7 Drawing Figures

Figure 1:
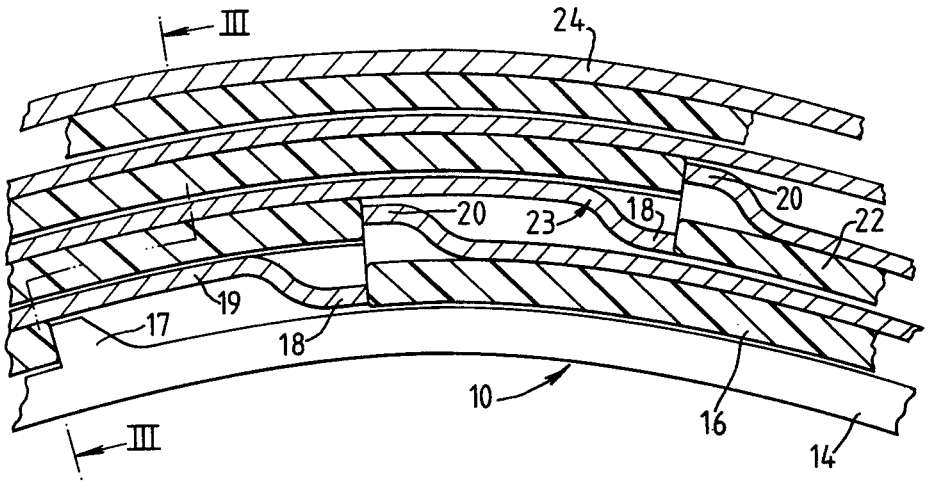

FIG. 3.
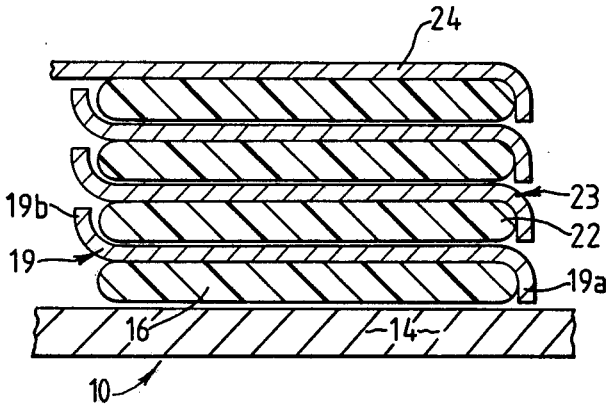
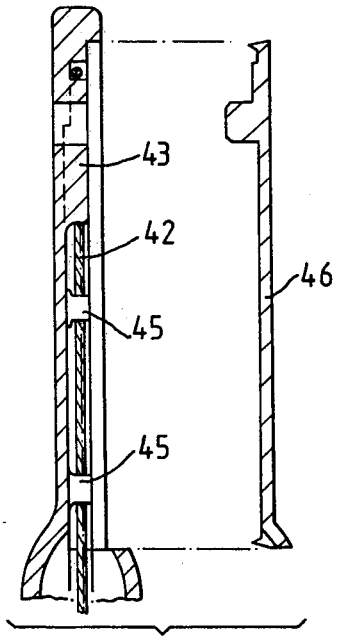
FIG. 7.

TEMPERATURE SENSITIVE ACTUATOR AND FAN

The invention relates to a temperature-sensitive actuator, to a fan embodying such an actuator for adjusting the pitch of blades mounted on a hub of the fan, and to means for retaining the blades on the hub.

We have proposed hitherto an actuator including an elongate member in the form of a coil, and a coil support arranged to exert a radial force on the coil as a result of relative thermal expansion or contraction between the coil and the coil support. In this manner, adjacent turns of the coil move relatively to each other around the axis of the coil in response to temperature variations to provide an output motion at one end of the coil.

Whilst such a unit can function, it has been found that successful operation will depend to a large extent on there being a minimum of friction between the coil and its support. With the elongate member in the form of a coil, the output motion obtained depends on the ability of each turn to overcome the friction between the support means and the succeeding turns. This may be illustrated by taking a coil which has six turns, turn number one being restrained against movement at its free end, and the free end of turn number six being the motion output end. During thermal expansion, expanding turn number one must move all five succeeding turns if it is to move circumferentially. Therefore it has to overcome the friction between the coil support and the remaining turns as well as overcoming its own friction. Each turn, except for turn number six, has to move the coils which are ahead of it. With the best commercially available low-friction materials, the optimum number of turns has been found to be five or six beyond which the available energy output diminishes rapidly. The addition of further turns generates more friction than can be overcome by the extra turns, and motion output falls until it disappears completely, the collective energy of all turns being absorbed within the system and resulting in distortion and permanent damage to the coil. An object of the invention is to provide a temperature sensitive actuator in which the foregoing disadvantages are avoided.

According to one aspect of the invention, a temperature-sensitive actuator includes at least first and second elongate members, support means for the first elongate member having a coefficient of expansion different from that of the first elongate member, means for restraining one end of the first elongate member, said support means being arranged to inhibit transverse deformation of the first elongate member during thermal expansion or contraction so that the free end of the first elongate member moves longitudinally relatively to the restraining means, and means arranged between the elongate members to transmit the movement to the second elongate member.

According to another aspect of the invention there is provided a temperature sensitive fan including a hub having variable-pitch blades spaced around its periphery, at least first and second circular or part circular elongate members arranged within the hub, support means for the first elongate member having a coefficient of expansion different from that of the first elongate member, and means on the hub for restraining one end of the first elongate member, said support means being arranged to inhibit radial deformation of the first elongate member during thermal expansion or contraction so that the free end of the first elongate member moves circumferentially relatively to the restraining means, means arranged between the elongate members to transmit the movement to the second elongate member so that this is displaced circumferentially as well as undergoing its own circumferential thermal expansion or contraction, and further means arranged between the second elongate member and the blades to vary the pitch of the blades in response to the combined expansion or contraction of the elongate members.

Preferably, support means is provided for the second elongate member having a coefficient of expansion different from that of the second elongate member, the second support means being arranged to inhibit radial deformation of the second elongate member during thermal expansion or contraction.

In order to make the arrangement as compact as possible and to improve dynamic balancing, the elongate members and respective support means are preferably concentric.

The means for transmitting movement from the first elongate member to the second elongate member may be provided on the first support means, the free end of the first elongate member being connected to or abutting one part of said means so that the first support means moves as the first elongate member expands or contracts and one end of the second elongate member being connected to or abutting another part of said means so that movement of the first support means is transmitted to the second elongate member. Conveniently, the two parts of said means for transmitting movement from the first elongate member to the second elongate member may comprise two projections one of which projects radially inwardly and is connected to or in abutment with the first elongate member, and the other of which projects radially outwardly and is connected to or in abutment with said one end of the other elongate member. In such a case the opposite end of the second elongate member is preferably connected to or in abutment with a radially inward projection on the second support means so that the second support means moves circumferentially during expansion or contraction of the elongate members. The second support means may be formed with a radially outward projection for transmitting circumferential movement of the second support means to one or more concentric radially outer elongate members having associated support means formed with movement transmitting projections.

According to a further aspect of the invention, there is provided a fan having variable pitch blades supported by a hub, each said blade being restrained against movement radially of the hub by a flexible cable or filament extending through the blade and into the hub.

Preferably, the cable or filament is in the form of a loop one portion of which is anchored to the hub and a further portion of which passes around an anchorage adjacent the radial extremity of its blade.

Figure 2:
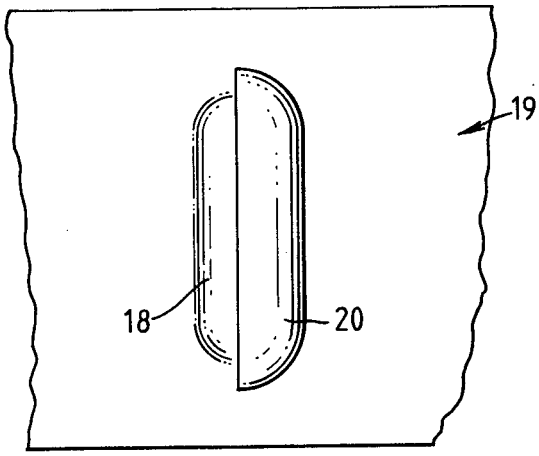

The invention will now be described by way of example only with reference to the accompanying drawings in which:

FIG. 1 is a cross section through part of a hub of a fan showing details of a temperature-sensitive actuator in the hub, FIG. 2 is a plan view of part of a movement transmitting means of the actuator, FIG. 3 is a cross sectional view on the line III—III in FIG. 1.

Figure 4:
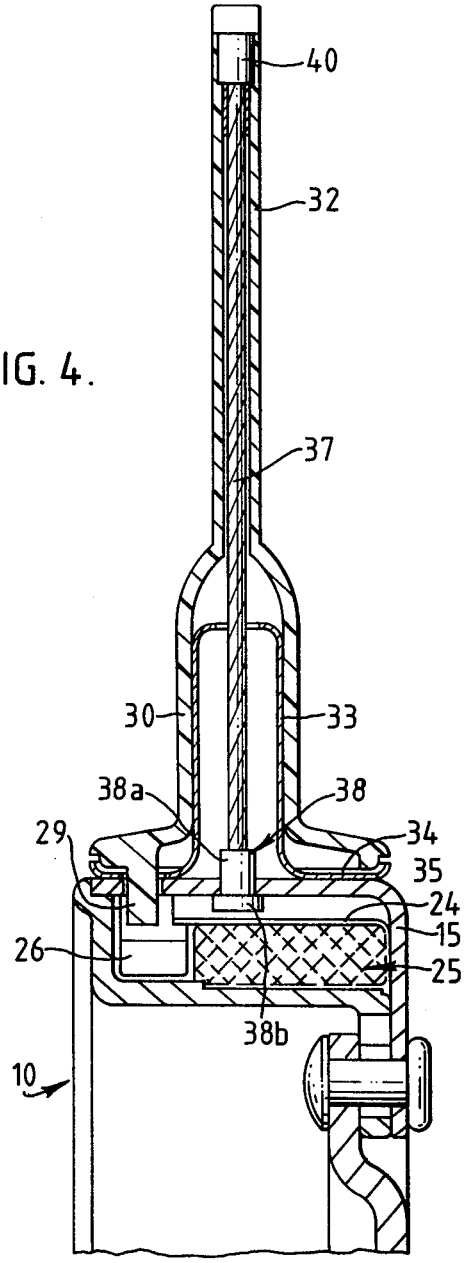
Figure 5:
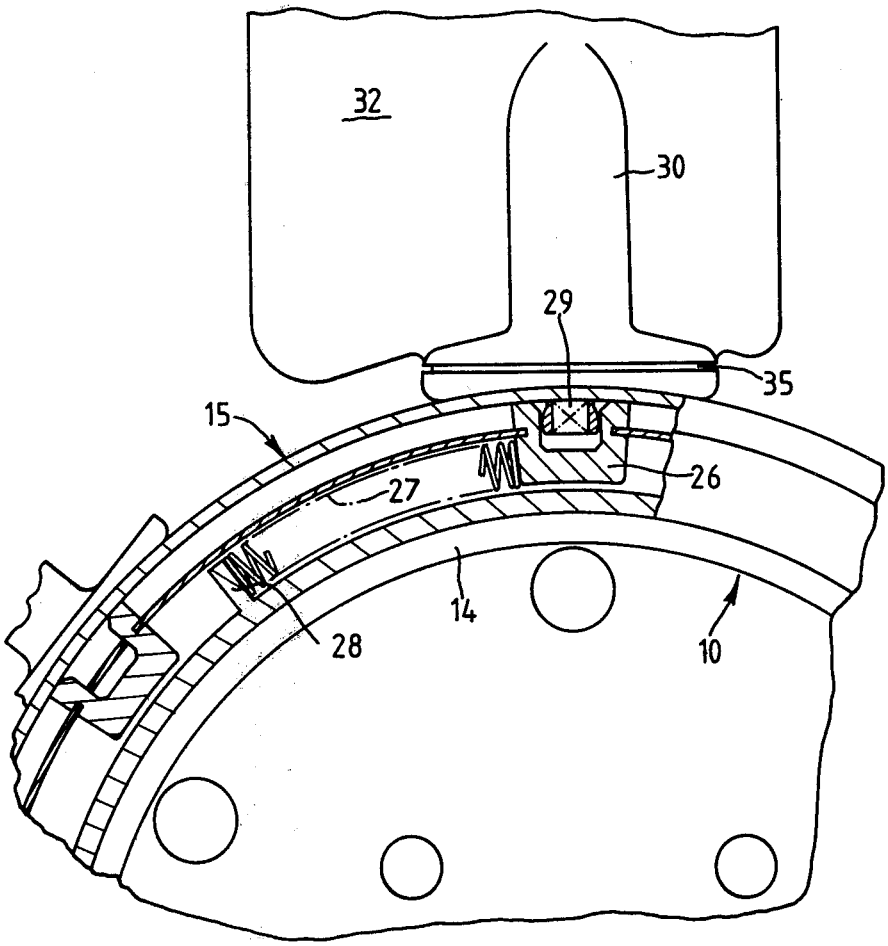
Figure 6:
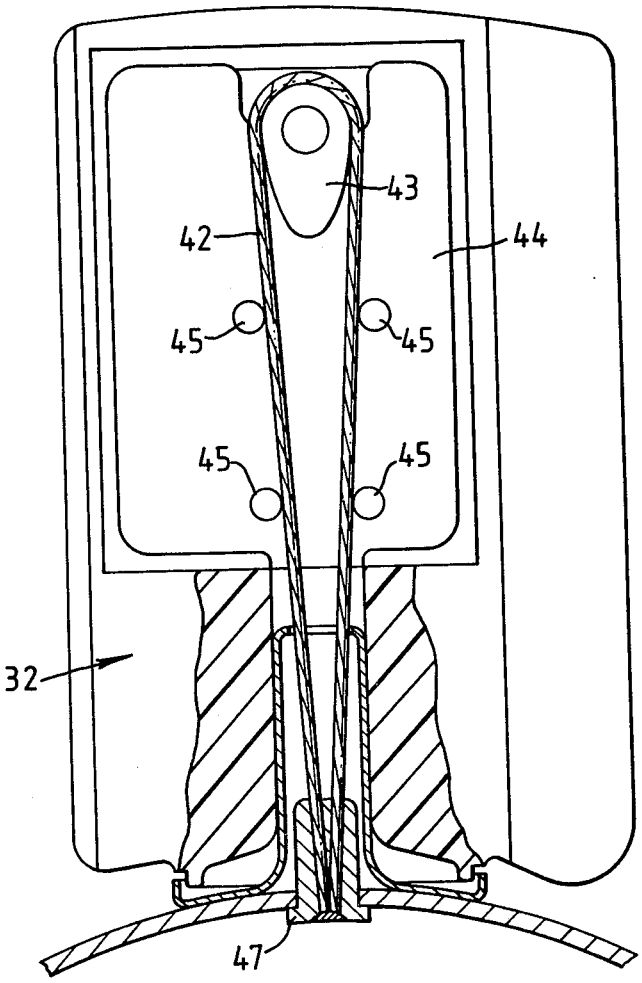

FIG. 4 is a cross sectional view through a variable pitch blade and part of the hub on which it is mounted, FIG. 5 is an elevation of part of the hub and fan shown in FIG. 4 showing part of the hub broken away, FIG. 6 is a cross sectional view through an alternative form of variable pitch blade and part of the hub on which it is mounted, and FIG. 7 is a view of the blade shown in FIG. 6 on the line VII—VII in FIG. 6.

Referring firstly to FIGS. 1, 2 and 3, a fan hub 10 has a cylindrical inner section 14 and a cylindrical outer section 15 (see FIGS. 4 and 5) with a temperature-sensitive actuator disposed between them. The actuator comprises a first strip of plastics material 16 bent into the form of a partial ring which is hereinafter referred to as a ring. One end of the ring 16 abuts a stop 17 on the inner section 14, and the other end of the ring abuts a projection 18 on a sheet metal housing 19 which constitutes the aforesaid movement transmitting means. The housing 19 is cylindrical and extends around the ring 14 so that the ring 14 is sandwiched with working clearance between the housing and the inner section 14. The housing 19 is formed with a further projection 20 which engages one end of a further plastics ring 22 and has in-turned and out-turned edges 19*a*, 19*b*. The projections 18, 20 may conveniently be formed by pressing the ring radially inwardly and radially outwardly simultaneously so as to shear a section of the ring to produce projections as shown in FIG. 2. The other end of the ring 22 abuts the projection 18 of a second housing 23 so that the second ring is sandwiched between the first and second housings with working clearance. The number of strips and housings can then be increased as desired so that the free end of the final ring (which abuts an unshown radially inwardly extending projection on an outermost housing 24) provides the appropriate amount of movement during thermal expansion of the rings.

Referring now to FIGS. 4 and 5, the outermost housing 24 of the actuator (indicated generally at 25) extends beyond the left-hand end of the actuator and locates a series of equi-spaced pockets 26. A plurality of springs 27 (one only of which is shown in FIG. 5) may be used between respective pockets 26 and abutments 28 on the inner section 14 of the hub. During thermal expansion of the plastics rings in the actuator 25, the pockets 26 will be moved against the bias of each spring 27. Without the spring, subsequent thermal contraction of the rings would simply cause a space to be left between the projection 18 of each housing and the adjacent end of the associated ring. Thus, contraction of the rings would not, in itself, move the pockets 26 back to their original positions. However, the bias of the spring 27 ensures that the pockets 26 will resume their original position during contraction of the rings in the actuator. Alternatively or additionally, blades may be used which have an aerodynamic balance such that air flow created by the fan during rotation applies a return bias to the blades. The pockets 26 receive inwardly extending fingers 29, each of which is integral with a root 30 of a blade 32. The root 30 is hollow and is rotatably mounted on a cylindrical spigot 33. The spigot is preferably a sheet-metal pressing secured to the outer section 15 of the hub. The lower end of the spigot 33 is formed as an annular trough which provides a working clearance 34 beneath the radially inner end of a skirt 35 on the blade root 30. The finger 29 extends through aligned slots in the trough and the outer section 15 of the hub. Each blade 32 is secured radially by means of a multi-strand wire 37. The radially inner end of the wire is secured to a nipple 38, the body 38*a* of which passes with working clearance through an aperture in the outer section 15 coaxial with the spigot 33. The head 38*b* of the nipple 38 is of a larger diameter than the aperture in the outer section. The radially outer end of the wire 37 is suitably anchored adjacent the extremity of the blade 32 in a nipple 40. During rotation of the fan, the wires 37 will restrain the blades against outward movement due to centrifugal force. Very high centrifugal forces are produced by fan revolutions which may rise in extreme cases to 10,000 r.p.m. However, the blade root will not be urged against any bearing surfaces by centrifugal force and, although the head of the nipple 38 will lock against the hub at such speeds, the wire 37 is able to twist and thereby facilitate variation of the blade pitch. It is desirable to make the cable as long as possible in order to gain maximum flexibility and to minimise resistance when the blade is turned through an angle of, say, 30°.

Instead of anchoring the radially outer end of the blade retaining wire in a nipple, the wire could be in the form of a loop 42 as shown in FIG. 6. The loop passes around a projection 43 formed integrally with the blade 32 and is housed in a recess 44 formed in the blades. Guides 45 integral with the blade assist in positioning the loop in the recess 44 during assembly. A cover 46 is attached to the blade to cover the recess when the loop is in situ. The free ends of the loop 42 are joined together and are secured to a nipple 47 which may be in the form of a die casting, a crimped tube or other suitable form. The nipple 47 corresponds to the nipple 38 in FIG. 4 and the flexibility of the wire loop accommodates turning movement of the blade during pitch variation.

Variation of pitch will occur when the pocket 26 moves during expansion and contraction of the rings in the actuators, movement of the fingers 29 rotating the blades about the spigots 33.

Although the actuator described utilises projections on housings 19, 23 to transmit movement from one ring to another, it is envisaged that movement transmitting means could comprise a projection at one end of one ring which extends through a slot in a cylindrical surrounding housing and locates in a complementary recess at one end of an adjacent ring and so on.

Whilst the rings of the actuator shown in FIGS. 3 to 5 have been shown one within the other, it is envisaged that they may be arranged coaxially side by side. In such a case, the rings could be of the same or different diameters. It is also envisaged that they may be arranged side by side non-coaxially if desired.

The temperature-sensitive actuator of the present invention is advantageous over that which we previously proposed as the rings do not have to overcome a build up of friction between successive rings and their associated housings. Thus, the operation of the actuator of the present invention does not so much depend on the use of material providing the same degree of low-friction as is necessary for our coil-type actuator to operate successfully. However it has been found advantageous to use the best commercially available low-friction means in the actuator so as to obtain maximum efficiency.

It will be appreciated that the actuator shown is built up from a number of stages, each stage comprising a ring and a housing and each housing being arranged to move with its associated ring. Whereas the optimum number of turns in the coil-type actuator was found to be five or six, the number of stages in the present actuator does not have any operational limitation. In fact, the number of stages to be incorporated is now dependent on the space available to accommodate them rather than on frictional factors.

A further disadvantage of the coil-type actuator is that it may not give constant results even when using the best commercially available low-friction materials and treatment. For example, with a coil-type actuator, it was found possible on test to move a load of 35 oz through a distance of 0.28 inches due to an increase in temperature from 150° F. to 200° F. However, due to overload degradation of the coil, the result obtained was unrepeatable. With an actuator in accordance with the invention, it was found possible to move a load of 60 oz repeatedly through a distance of 0.26 inches over the same temperature range.

The coil of the previous actuator was formed from rodding whereas the present actuator utilises strip. An advantage of using strip instead of rodding is that it conveniently presents a greater cross-sectional area for a given thickness and this may carry much higher loads with reduced risk of distortion.

It is envisaged that the temperature-sensitive actuator of the present invention could be used for purposes other than varying the pitch of blades on a fan.

The rings are preferably made from an acetal plastics material sold under the Trade Mark KEMETAL or an alternative form of suitable acetal plastics is sold under the Trade Mark HOST AFORM C.

The wire 37 is preferably a steel cable but may be in the form of one or more single strand filaments.

Although the embodiment described operates in response to thermal expansion, it could be suitably adapted to operate as a result of thermal contraction.

What I claim as my invention and desire to secure by Letters Patent of the United States is:

1. A temperature-sensitive actuator including at least first and second circular or part circular elongate members;

respective first and second circular or part circular support means for the first and second elongate members, each having a coefficient of expansion different from that of the elongate members, said first and second support means being arranged to inhibit transverse deformation of the elongate members during thermal expansion or contraction;

means restraining one end of the first elongate member so that the free end of the first elongate member moves circumferentially relatively to the restraining means during thermal expansion or contraction, and means arranged between the opposite end of the first elongate member and one end of the second elongate member to transmit the circumferential movement of the first elongate member to the second elongate member;

the circumferential movement of the opposite end of the second elongate member due to cumulative expansion or contraction of the elongate members being transmitted in use to means to be operated by the actuator.

2. A temperature-sensitive actuator according to claim 1 in which the circumferential movement of the said opposite end of the second elongate member is transmitted to said means to be operated by the actuator through one or more further circular or part circular elongate members in respective support means so that the cumulative circumferential movement of all the elongate members due to circumferential expansion or contraction thereof is transmitted in use to the means to be operated by the actuator.

3. A temperature-sensitive actuator according to claim 1, in which the means for transmitting movement from the first elongate member to the second elongate member is provided on the first support means, the free end of the first elongate member being connected to or abutting one part of said means so that the first support means moves as the first elongate member expands or contracts and said one end of the second elongate member being connected to or abutting another part of said means, so that movement of the first support means is transmitted to the second elongate member.

4. A temperature-sensitive actuator according to claim 3, in which the elongate members and respective support means are concentric.

5. A temperature-sensitive actuator, according to claim 4, in which the parts of said means for transmitting movement from the first elongate member to the second elongate member comprise two projections one of which projects radially inwardly and is connected to or in abutment with the first elongate member, and the other of which projects radially outwardly and is connected to or in abutment with said one end of the second elongate member.

6. A temperature-sensitive actuator, according to claim 5, in which each support means is formed from sheet metal and the projections are formed by deforming portions of the sheets at selected positions.

7. A temperature-sensitive actuator, according to claim 5, in which the opposite end of the second elongate member is connected to or in abutment with a radially inward projection on the second support means so that the second support means moves circumferentially during expansion or contraction of the elongate members.

8. A temperature-sensitive actuator according to claim 7, in which the second support means is formed with a radially outward projection for transmitting circumferential movement of the second support means to one or more concentric radially outer elongate members having associated support means formed with movement transmitting projections whereby cumulative circumferential movement of all the elongate members due to circumferential expansion thereof is transmitted to the means to be operated by the actuator.

9. A temperature-sensitive actuator including first and second concentric circular or part circular elongate members, respective first and second concentric circular or part-circular support means for the first and second elongate members each having a coefficient of expansion different from that of the elongate members, said first and second support means being arranged to inhibit transverse deformation of the elongate members during thermal expansion or contraction, means restraining one end of the first elongate member so that the free end of the first elongate member moves circumferentially relatively to the restraining means during thermal expansion or contraction, means arranged between the other end of the first elongate member and one end of the second elongate member to transmit the circumferential movement of the first elongate member to the second elongate member, the means for transmitting said circumferential movement comprising two projections on the first support means one of which projects radially inwardly and is connected to or in abutment with the other end of the first elongate member, and the other of which projects radially outwardly and is connected to or in abutment with said one end of the second elongate member, the second support means also having a radially inward projection connected to or in abutment with the other end of the second elongate member so that the second support means also moves circumferentially during expansion or contraction of the elongate members, the second support means also being formed with a radially outward projection for transmitting circumferential movement of the second support means to one or more concentric radially outer circular or part circular elongate members having associated support means formed with movement transmitted projections, an outer casing surrounding and having its inner periphery closely adjacent the radially outermost support member and means extending through the casing and engaging the radially outermost support member for transmitting movement due to cumulative expansion of the concentric elongate members to a device to be operated by the actuator.

* * * * *